US007802867B2

(12) United States Patent
Sakurai

(10) Patent No.: US 7,802,867 B2
(45) Date of Patent: Sep. 28, 2010

(54) LIQUID JETTING APPARATUS AND MAINTENANCE METHOD OF THE LIQUID JETTING APPARATUS

(75) Inventor: Hisaki Sakurai, Aichi-ken (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 253 days.

(21) Appl. No.: 12/221,744

(22) Filed: Aug. 6, 2008

(65) Prior Publication Data

US 2009/0058908 A1 Mar. 5, 2009

(30) Foreign Application Priority Data

Aug. 6, 2007 (JP) ..... 2007-204027

(51) Int. Cl.
*B41J 2/165* (2006.01)
*B41J 2/195* (2006.01)
*B41J 2/175* (2006.01)

(52) U.S. Cl. ..... 347/23; 347/22; 347/7; 347/86

(58) Field of Classification Search ..... 347/22–24, 347/29, 30, 32, 33, 35, 7, 14, 19, 86; 358/296
See application file for complete search history.

(56) References Cited

U.S. PATENT DOCUMENTS 5,136,309 A * 8/1992 Iida et al. ..... 347/7
5,592,200 A * 1/1997 Kaneko ..... 347/30
6,042,218 A * 3/2000 Nakahara ..... 347/35
6,771,378 B2 * 8/2004 Akiyama et al. ..... 358/1.14
6,786,566 B2 * 9/2004 Shindo ..... 347/30
7,185,970 B2 * 3/2007 Hamasaki ..... 347/23

FOREIGN PATENT DOCUMENTS

| | | |
|---|---|---|
| JP | 60-60054 | 12/1985 |
| JP | 2774049 | 4/1998 |
| JP | 2774841 | 4/1998 |

* cited by examiner

*Primary Examiner*—Shih-wen Hsieh
(74) *Attorney, Agent, or Firm*—Eugene LeDonne; Joseph w. Treloar; Frommer Lawrence & Haug LLP

(57) ABSTRACT

A liquid jetting apparatus includes: a first liquid jetting head having a nozzle which jets a first liquid supplied from a first liquid supply source; a second liquid jetting head having a nozzle which jets a second liquid supplied from a second liquid supply source; a liquid shortage detecting section detecting shortage of the first liquid in the first liquid supply source; a state detecting section which detects a state of the first liquid jetting head since a time at which the shortage of the first liquid has been detected by the liquid shortage detecting section up to a time at which the shortage of the first liquid is solved; a recovery mechanism which performs a recovery operation of the first liquid jetting head and the second liquid jetting head; and a controller which controls the first liquid jetting head, the second liquid jetting head, and the recovery mechanism.

18 Claims, 11 Drawing Sheets

LIQUID JETTING APPARATUS AND MAINTENANCE METHOD OF THE LIQUID JETTING APPARATUS

CROSS REFERENCE TO RELATED APPLICATION

The present application claims priority from Japanese Patent Application No. 2007-204027, filed on Aug. 6, 2007, the disclosure of which is incorporated herein by reference in its entirety.

BACKGROUND OF THE INVENTION

1. Field of the Invention

The present invention relates to a liquid jetting apparatus which jets liquid from nozzles and a maintenance method of the liquid jetting apparatus.

2. Description of the Related Art

As described in Japanese Examined Patent Publication (Kokoku) No. 60-60054, in a color image forming apparatus which forms an image by using coloring materials of a plurality of colors, it has been known that, when shortage of any one color material of the plural color materials occurs, the image formation with the color material is prohibited and the image formation with the other color materials is enabled.

From the same viewpoint described in Japanese Examined Patent Publication (Kokoku) No. 60-60054, in a liquid jetting apparatus, for example, in an inkjet printer, when shortage of color ink occurs, printing with the color ink is prohibited and only printing with black ink is enabled until the color ink is refilled, which offers a user improved convenience.

Here, in the case where printing with one ink (first liquid) is prohibited and only printing with the other ink (second liquid) is enabled as described above, recovery operations such as flashing in which the second liquid is jetted by driving a liquid jetting head and purging in which the second liquid is sucked out from nozzles to be discharged to the outside are performed in the liquid jetting head, in order to prevent an increase in liquid viscosity in the nozzles from which the second liquid is jetted. At this time, if the flashing and purging are also performed with respect to the nozzles which jet the first liquid, a great amount of air is led from an empty ink supply source into a liquid jetting head which jets the first liquid, which makes it difficult to recover the liquid jetting head of the first liquid into a state where it can jet the liquid.

On the other hand, if the flashing and purging with respect to the liquid jetting head which jets the ink as the first liquid is totally prohibited, and if a user often uses the second liquid, the liquid jetting head of the first liquid is left unused for a long period, and the liquid jetting head of the first liquid is exposed to a dry state while the liquid jetting head of the second liquid is operating. Accordingly, the increase in the liquid viscosity in the liquid jetting head of the first liquid progresses with time. Therefore, depending on the degree of the increase in the liquid viscosity in the jetting head, it is necessary to perform the flashing or the purging when the first liquid is refilled, for the purpose of solving the problem of the increase in the liquid viscosity in the liquid jetting head of the first liquid. However, if the flashing or the purging is indiscriminatingly performed at this time, depending on the degree of the viscosity increase of the ink liquid in the liquid jetting head, there is a risk that the liquid may be discharged wastefully or more than necessary, or the increase in the liquid viscosity may not be fully solved.

SUMMARY OF THE INVENTION

It is an object of the present invention to provide a liquid jetting apparatus and a maintenance method of the liquid jetting apparatus enabling jetting a second liquid when shortage of a first liquid occurs, in which the first liquid in a liquid jetting head is surely prevented from increasing in viscosity while the jetting of the second liquid is continued, the first liquid is prevented from being discharged more than necessary in an effort to solve the viscosity increase of the first liquid, and a large amount of gas is not led into the liquid jetting head.

According to a first aspect of the present invention, there is provided a liquid jetting apparatus including: a first liquid jetting head having a nozzle which jets a first liquid supplied from a first liquid supply source storing the first liquid; a second liquid jetting head having a nozzle which jets a second liquid supplied from a second liquid supply source storing the second liquid; a liquid shortage detecting section detecting shortage of the first liquid in the first liquid supply source; a state detecting section which detects a state of the first liquid jetting head since a time at which the shortage of the first liquid has been detected by the liquid shortage detecting section up to a time at which the shortage of the first liquid is solved; a recovery mechanism which performs a recovery operation of the first liquid jetting head and the second liquid jetting head; and a controller which controls the first liquid jetting head, the second liquid jetting head, and the recovery mechanism, and the controller controls the second liquid jetting head to jet the second liquid irrespective of a detection result of the shortage of the first liquid by the liquid shortage detecting section; the controller controls the first liquid jetting head to restrict the jetting of the first liquid by the first liquid jetting head and controls the recovery mechanism to restrict the recovery operation with respect to the first liquid jetting head since the time at which the shortage of the first liquid has been detected by the liquid shortage detecting section up to the time at which the shortage of the first liquid is solved; and the controller controls, after the shortage of the first liquid is solved, the recovery mechanism based on the state of the first liquid jetting head, detected by the state detecting section, to perform the recovery operation.

According to the first aspect of the present invention, even when the shortage of the first liquid occurs, the second liquid jetting head can be operated to jet the second liquid, which offers a user improved convenience.

Further, if the recovery operation with respect to the first liquid jetting head as well as the second liquid jetting head is continued after the shortage of the first liquid occurs, a large amount of air is led into the first liquid jetting head, which makes it difficult to recover the first liquid jetting head into a state where it can jet the liquid. However, in this aspect, since the recovery operation with respect to the first liquid jetting head is restricted when the shortage of the first liquid occurs, the air is not easily led into the first liquid jetting head.

In the liquid jetting apparatus of the present invention, the state detecting section may be a timer which detects a time period since the time at which the shortage of the first liquid has been detected by the liquid shortage detecting section up to the time at which the shortage of the first liquid is solved; the recovery mechanism may cause the liquids in the first liquid jetting head and the second liquid jetting head to be discharged outside of the first and second liquid jetting heads respectively to prevent a viscosity increase of the liquids in the first liquid jetting head and the second liquid jetting head; the controller may control the first liquid jetting head to stop jetting of the first liquid by the first liquid jetting head and may control the recovery mechanism to stop the recovery operation of the first liquid jetting head since the time at which the shortage of the first liquid has been detected by the liquid shortage detecting section up to the time at which the shortage of the first liquid is solved; and the controller may control, after the shortage of the first liquid is solved, the recovery mechanism based on the time period detected by the timer to perform the recovery operation. In this case, if the recovery operation with respect to the first liquid jetting head is stopped and the operation with respect to the second liquid jetting head is continued when the shortage of the first liquid occurs, the viscosity increase of the first liquid progresses with time, and therefore, if the recovery operation is indiscriminatingly performed when the shortage of the first liquid is solved, there is a risk that the first liquid may be discharged more than necessary or conversely the viscosity increase of the first liquid in the first liquid jetting head may not be fully solved. However, in the present invention, when the shortage of the first liquid is solved, the recovery operation by the recovery mechanism is controlled based on the time period from the occurrence of the shortage of the first liquid. Therefore, the viscosity increase of the first liquid in the first liquid jetting head is surely solved and the first liquid is not discharged more than necessary.

In the liquid jetting head of the present invention, the recovery mechanism may perform a purge operation or a flashing operation as the recovery operation, the purge operation being an operation for discharging the first liquid in the first liquid jetting head from the nozzle by changing from outside of the first liquid jetting head a pressure in the first liquid in the first liquid jetting head and the flashing operation being a operation for causing the nozzle to jet the first liquid by driving the first liquid jetting head; and the controller may control the recovery mechanism to perform the purge operation, the flashing operation, or selective combination of the purge operation and the flashing operation, based on the time period detected by the timer. When, as the recovery operation, the purge operation or the flashing operation is selectively performed, the purge operation, the flashing operation, or the selective combination thereof is performed according to the time period from the time at which the shortage of the first liquid has occurred up to the time at which the shortage of the first liquid is solved. Consequently, the viscosity increase of the first liquid in the first liquid jetting head can be surely solved and the first liquid is not discharged more than necessary.

In the liquid jetting apparatus of the present invention, the first liquid jetting head may be an inkjet head which jets a color ink as the first liquid, and the second liquid jetting head may be an inkjet head which jets a black ink as the second liquid. When the first liquid jetting head is the inkjet head jetting the color ink and the second liquid jetting head is the inkjet head jetting the black ink, monochrome printing can be performed only with the black ink even if the shortage of the color ink occurs, which offers a user improved convenience. Further, since the recovery mechanism is controlled based on the state when the shortage of the color ink is solved, the viscosity increase of the color ink in the first liquid jetting head is surely solved and the color ink is not discharged more than necessary by the recovery operation.

The liquid jetting apparatus of the present invention may further include a carriage to which the first liquid jetting head and the second liquid jetting head are attached and which reciprocates in a predetermined direction and a cap which covers the nozzles of the first liquid jetting head and the nozzles of the second liquid jetting head, when both of the first liquid and the second liquid are not discharged, to prevent the nozzles from being dried.

In the liquid jetting apparatus of the present invention, the first liquid jetting head and the second liquid jetting head may be integrally formed.

The liquid jetting apparatus of the present invention may further include a first connection channel which connects the first liquid supply source and the first liquid jetting head; and a second connection channel which connects the second liquid supply source and the second liquid jetting head, and the recovery mechanism may have an air-discharge mechanism which discharges gas in the first connection channel to outside of the first connection channel; the state detecting section may be a flashing-times detecting section which detects a number of times the first liquid jetting head performs a flashing operation, during the period since the time at which the shortage of the first liquid has been detected by the liquid shortage detecting section up to the time at which the shortage of the first liquid is solved, the flashing operation being an operation for jetting the first liquid from the nozzle to prevent a viscosity increase of the first liquid in the nozzle of the first liquid jetting head; the controller may include: a flashing control section which controls the first liquid jetting head to perform the flashing operation; an air-discharge control section which controls the air-discharge mechanism to discharge the gas in the first connection channel; and a jetting control section which controls the first liquid jetting head and the second liquid jetting head to jet the first and the second liquids respectively, based on user data; the jetting control section may control the first liquid jetting head to stop the jetting of the first liquid based on the user data and may control the second liquid jetting head to jet the second liquid, during a period since the time at which the shortage of the first liquid has been detected by the liquid shortage detecting section up to the time at which the shortage of the first liquid is solved; the flashing control section may control the first liquid jetting head to perform the flashing operation during the period since the time at which the shortage of the first liquid has been detected by the liquid detecting unit up to the time at which the shortage of the first liquid is solved; and the air-discharge control section may control, when the shortage of the first liquid is solved, the air-discharge mechanism based on the number of times the flashing operation is performed, detected by the flashing-times detecting section, to discharge the gas in the first connection channel.

With the above structure, even when the shortage of the first liquid occurs, the second liquid jetting head can be operated to jet the second liquid, which offers a user improved convenience.

Further, if the first liquid jetting head does not discharge the first liquid at all and the operation of the second liquid jetting head is continued since the time at which the shortage of the first liquid has occurred up to the time at which the shortage of the first liquid is solved, there is a risk that the viscosity of the first liquid in the first liquid jetting head may greatly increase. However, in the present invention, even in the state where the shortage of the first liquid occurs, the flashing is performed in the first liquid jetting head, which can suppress the viscosity increase of the first liquid in the first liquid jetting head.

Further, if the flashing operation is continued in the first liquid jetting head even after the shortage of the first liquid occurs, gas is led into the first connection channel from the empty first liquid supply source, and the greater the number of times the flashing operation is performed, the greater an amount of the led-in gas. Therefore, in the present invention, the air-discharge mechanism is controlled based on the number of times of the flashing operation from the time at which the shortage of the liquid in the first liquid supply source has occurred up to the time at which the shortage of the first liquid is solved. Consequently, it is possible to appropriately discharge the gas to the outside based on an amount of the gas led into the first connection channel.

In the liquid jetting apparatus of the present invention, when the shortage of the first liquid is solved, the air-discharge control section may control the air-discharge mechanism to discharge the gas in an amount which is increased, as the number of times the flashing operation is performed, which is detected by the flashing-times detecting section, becomes greater. In this case, the greater the number of times the flashing operation is performed since the time at which the shortage of the first liquid has occurred up to the time at which the shortage of the first liquid is solved, the larger an amount of the gas in the first connection channel, and therefore, by increasing an amount of the gas discharged by the air-discharge mechanism when the shortage of the first liquid is solved, it is possible to fully discharge the gas in the first connection channel.

In the liquid jetting apparatus of the present invention, when the liquid shortage is not detected by the liquid shortage detecting section, the air-discharge control section may control the air-discharge mechanism to discharge the gas in the first connection channel and the second connection channel at a predetermined air-discharge cycle; and then when the shortage of the first liquid is solved and when the number of times of the flashing operation detected by the flashing-times detecting section is smaller than a predetermined number of times, the air-discharge control section may cause the gas in the first connection channel to be discharged to outside of the first connection channel at least once at a cycle shorter than the air-discharge cycle. In this case, when the number of times the flashing operation is performed since the time at which the shortage of the first liquid has occurred up to the time at which the shortage of the first liquid is solved is small, the gas exists at a position, in the first liquid connection channel, distant from the liquid jetting head and thus need not be immediately discharged, but an effort to discharge this gas necessitates discharging the liquid on a downstream side of the gas. However, in the present invention, the gas in the first connection channel is not immediately discharged and the air-discharge cycle is shortened, which enables relatively quick and efficient air-discharge. Further, the first liquid on the downstream side of the gas is not wastefully discharged.

In the liquid jetting apparatus of the present invention, the first liquid jetting head may be an inkjet head which jets a color ink as the first liquid, and the second liquid jetting head may be an inkjet head which jets a black ink as the second liquid.

According to a second aspect of the present invention, there is provided a maintenance method of a liquid jetting apparatus including a first liquid supply source storing a first liquid; a first liquid jetting head having a nozzle which jets the first liquid supplied from the first liquid supply source; a second liquid supply source storing a second liquid; a second liquid jetting head having a nozzle which jets the second liquid supplied from the second liquid supply source; a first connection channel connecting the first liquid supply source and the first liquid jetting head; and a second connection channel connecting the second liquid supply source and the second liquid jetting head, the method including: detecting shortage of the first liquid of the first liquid supply source; restricting a jetting operation of the first liquid jetting head and restricting a recovery operation of the first liquid jetting head; detecting a state of the first liquid jetting head since a time at which the shortage of the first liquid has been detected up to a time at which the shortage of the first liquid is solved; and performing the recovery operation of the first liquid jetting head based on the detected state of the first liquid jetting head.

If the recovery operation with respect to the first liquid jetting head as well as the second liquid jetting head is continued after the shortage of the first liquid occurs, a large amount of air is led into the first liquid jetting head, which makes it difficult to recover the first liquid jetting head into a state where it can jet the liquid. However, in this aspect, since the recovery operation with respect to the first liquid jetting head is restricted when the shortage of the first liquid occurs, air is not easily led into the first liquid jetting head.

In the maintenance method of the present invention, the second liquid may be jetted from the second liquid jetting head during a period while the jetting operation of the first liquid jetting head and the recovery operation of the first liquid jetting head are restricted. In this case, even when the shortage of the first liquid occurs, the second liquid jetting head can be operated to jet the second liquid, which offers a user improved convenience.

In the maintenance method of the present invention, the state of the first liquid jetting head since the time at which the shortage of the first liquid has been detected up to the time at which the shortage of the first liquid is solved may be a time period since the time at which the shortage of the first liquid has been detected up to the time at which the shortage of the first liquid is solved.

In the maintenance method of the present invention, the recovery operation of the first liquid jetting head may include a purge operation or a flashing operation, the purge operation being an operation for discharging the first liquid in the first liquid jetting head from the nozzle by changing a pressure from outside of the first liquid jetting head in the first liquid in the first liquid jetting head and the flashing operation being an operation for causing the nozzle to jet the first liquid by driving the first liquid jetting head.

The maintenance method of the present invention may further include comparing, with a predetermined time period, the time period since the time at which the shortage of the first liquid has been detected up to the time at which the shortage of the first liquid is solved, and the purge operation, the flashing operation, or selective combination of the purge operation and the flashing operation may be performed based on a result of the comparison.

In the maintenance method of the present invention, the state of the first liquid jetting head since the time at which the shortage of the first liquid has been detected up to the time at which the shortage of the first liquid is solved may be a number of times the first liquid jetting head performs a flashing operation since the time at which the shortage of the first liquid has been detected up to the time at which the shortage of the first liquid is solved, the flashing operation being an operation for jetting the first liquid from the nozzle to prevent a viscosity increase of the first liquid in the nozzle of the first liquid jetting head.

In the maintenance method of the present invention, the recovery operation of the first liquid jetting head may include an air-discharge operation of discharging gas in the first connection channel to outside of the first connection channel.

The maintenance method of the present invention may further include comparing, with a predetermined number of times, the number of times the first liquid jetting head performs the flashing operation since the time at which the shortage of the first liquid has been detected up to the time at which the shortage of the first liquid is solved, and the air-discharge operation may be performed based on a result of the comparison.

DETAILED DESCRIPTION OF THE PREFERRED EMBODIMENTS

Hereinafter, a suitable first embodiment of the present invention will be described.

Figure 1:
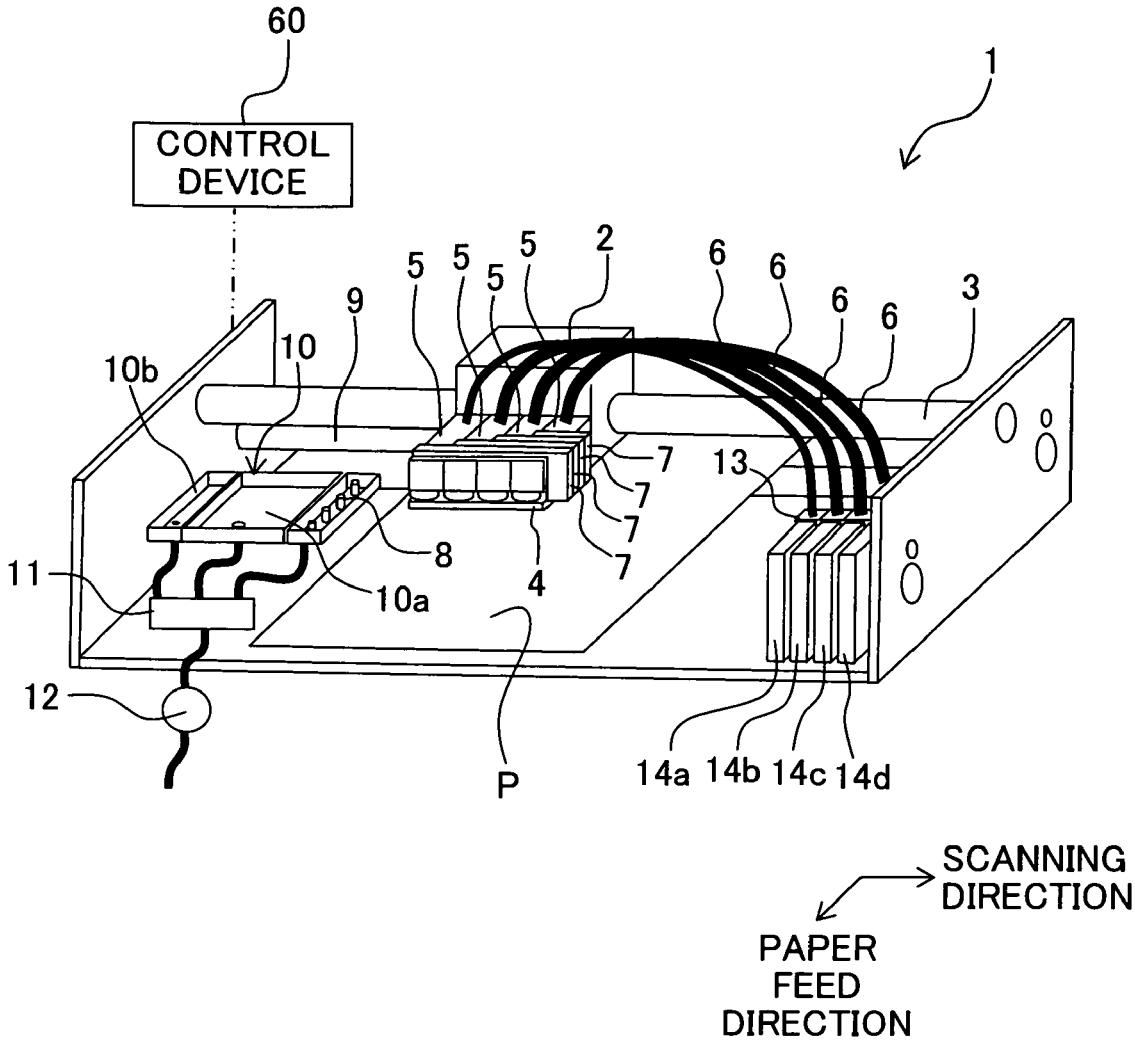
FIG. 1 is a view showing a schematic configuration of a printer according to a first embodiment.

FIG. 1 is a view showing a schematic configuration of a printer (liquid jetting apparatus) according to the first embodiment. As shown in FIG. 1, the printer 1 includes a carriage 2, a guide shaft 3, an inkjet head 4, sub-tanks 5, tubes 6, a paper feed roller 9, air-discharge cap 8, a purge cap 10, a switching device 11, a suction pump 12, and so on. The operation of the printer 1 is controlled by a control device 60 (controller).

The carriage 2 reciprocates in a right/left direction in FIG. 1 which is a scanning direction, along the guide shaft 3. The inkjet head 4 is attached to a lower surface of the carriage 2, and while reciprocating in the scanning direction with the carriage 2, the inkjet head 4 jets black ink (second liquid) and color (hereinafter yellow, cyan, and magenta will be referred to as three colors) inks (first liquid) from later-described nozzles 25 (see FIG. 2) (jetting operation) to print on recording paper P. That is, in the first embodiment, the inkjet head 4 corresponds to an integration of a first liquid jetting head and a second liquid jetting head according to the present invention.

Figure 3A:
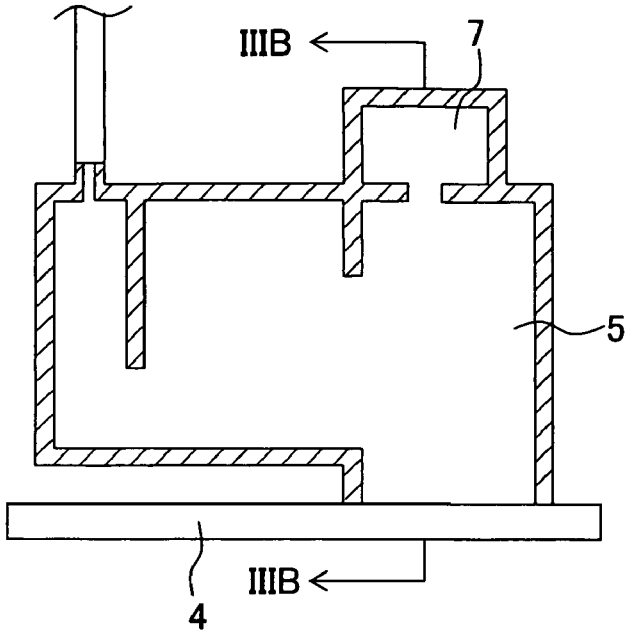
FIG. 3A is a vertical sectional view of the inkjet head and a sub-tank portion in FIG. 1.
Figure 3B:
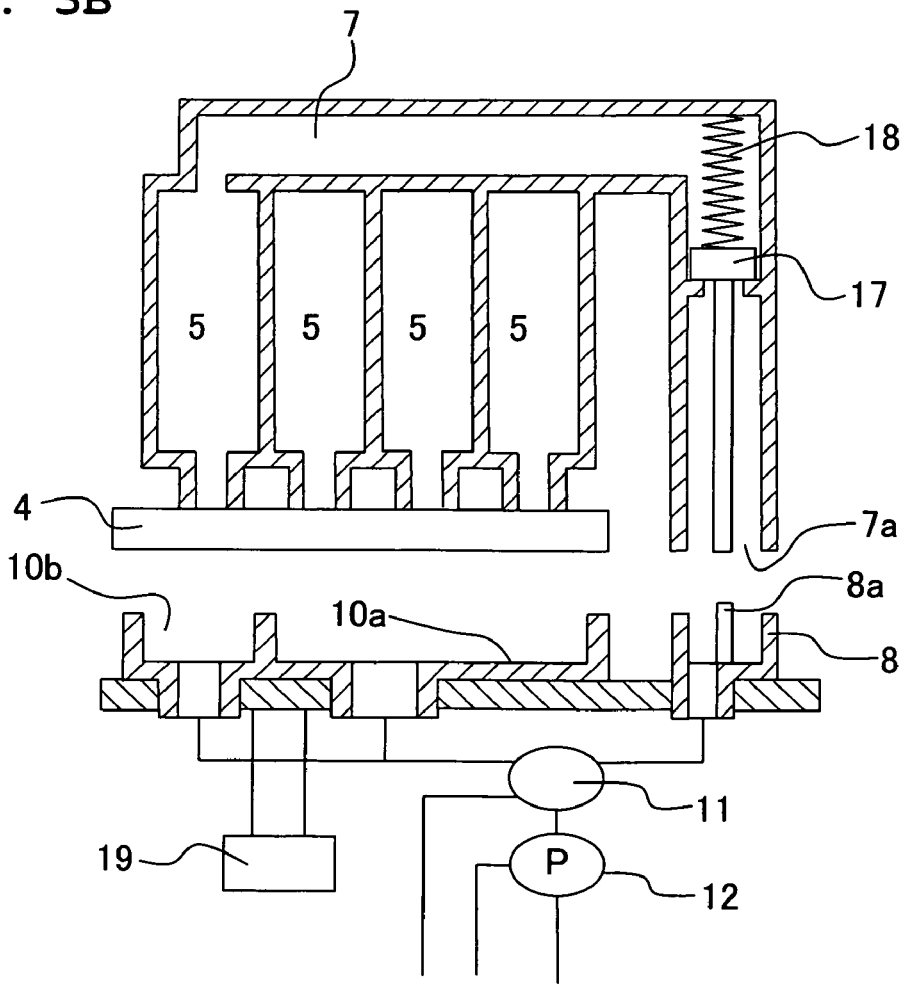
FIG. 3B is a cross-sectional view taken along line b-b in FIG. 3A and a cross-sectional view of a cap portion corresponding thereto.

Above the inkjet head 4, the four sub-tanks 5 are attached to the carriage 2. The sub-tanks 5 contain, from the left in FIG. 1, the black, yellow, cyan, and magenta inks respectively, and supply these inks to the inkjet head 4. Each of the sub-tanks 5 has an air-discharge channel 7 which extends from an upper surface of the sub-tank 5 to the right in FIG. 3B and its right end portion bends down at a substantially right angle, as shown in FIG. 3B. Lower ends 7*a* of the four air-discharge channels 7 are opened to the outside on the side of the inkjet head 4, and each of the air-discharge channels 7 includes a valve 17 therein. The air-discharge channels 7 are normally closed by the valves 17 from the outside by the operation of springs 18.

The four tubes 6 connect the four sub-tanks 5 and four ink supply sources, that is, ink cartridges 14*a* to 14*d*, attached to a stationary part 13 of the printer 1 outside the carriage 2. The ink cartridges 14*a* to 14*d* contain the black, yellow, cyan, and magenta inks respectively to supply these four color inks to the sub-tanks 5. Among the four ink supply sources, the ink cartridges 14*b* to 14*d* containing the yellow, cyan, and magenta inks correspond to a first liquid supply source according to the present invention, and the ink cartridge 14*a* containing the black ink corresponds to a second liquid supply source according to the present invention. Further, among pairs of the four tubes 6 and the four sub-tanks 5, a pair connected to the ink cartridge 14*a* for the black ink corresponds to a second connection channel according to the present invention, and pairs connected to the ink cartridges 14*b* to 14*d* for the color inks correspond to a first connection channel according to the present invention.

The paper feed roller 9 carries the recording paper P in a direction (paper feed direction) perpendicular to the scanning direction of the carriage 2 at a position below the nozzles 25 of the inkjet head 4.

In the printer 1, the air-discharge cap 8 and the purge cap 10 are provided on a side of a position where the recording paper P is carried. The air-discharge cap 8 and the purge cap 10 are movable in an up/down direction by a lift mechanism 19, and they move up when the carriage 2 moves to the outside of the position where the recording paper P is carried, so that the air-discharge cap 8 comes into close contact with the lower end openings 7*a* of the air-discharge channels 7 and the pure cap 10 comes into close contact with a lower surface of the inkjet head 4. The air-discharge cap 8 includes therein push-up projections 8*a*, and when the air-discharge cap 8 is connected to the lower end openings 7*a* of the air-discharge channels 7, the projections 8*a* push the valves 17 open, so that the air-discharge cap 8 is connected to upper spaces in the sub-tanks 5.

The purge cap 10 has a first capping part 10*a* and a second capping part 10*b*. When the purge cap 10 moves up as described above, the first capping part 10*a* covers the nozzles 25 of the color (yellow, cyan, and magenta) inks (to be described later) and the second capping part 10*b* covers the nozzles 25 of the black ink (to be described later) respectively.

Incidentally, the air-discharge cap 8, the first capping part 10*a*, and the second capping part 10*b* may be moved up/down by separate lift mechanisms respectively. The air-discharge cap 8 and the projections 8*a* therein may be moved up/down by separate lift mechanisms respectively. Further, the valve 17 of the air-discharge channel 7 connected to the sub-tank 5 of the black ink and the valves 17 of the air-discharge channels 7 connected to the sub-tanks 5 of the three color inks may be separately opened/closed.

The air-discharge cap 8, the first capping part 10*a*, and the second capping part 10*b* are connected to the suction pump 12 via the switching device 11. The switching device 11 switches between the connection of the air-discharge cap 8, the first capping part 10*a*, and the second capping part 10*b* to the suction pump 12 and their disconnection from the suction pump 12.

When the suction pump 12 is operated while the air-discharge cap 8 is connected to the air-discharge channels 7 and the air-discharge cap 8 and the suction pump 12 are connected by the switching device 11, air in the upper portions in the sub-tanks 5 is discharged to the outside. Here, such air-discharge of the air to the outside is performed at a predetermined air-discharge cycle. The air-discharge cap 8 and the suction pump 12 correspond to an air-discharge mechanism according to the present invention.

When the suction pump 12 is operated while the purge cap 10 covers the nozzles 25 and at least one of the first and second capping parts 10*a*, 10*b* is connected to the suction pump 12 by the switching device 11, the purging is performed, that is, the ink in the inkjet head 4 is sucked out from the nozzles 25 jetting the black ink and/or the nozzles 25 jetting the color inks.

A flashing operation is performed in such a manner that the carriage 2 moves to the position on the side of the position where the recording paper P is carried, and the inkjet head 4 is driven to jet the inks from all the nozzles 25 toward the purge cap 10 or a known vessel (not shown), as is generally known. In this embodiment, the flashing operation of the nozzles 25 which jet the black ink can also be performed separately from the flashing operation of the nozzles 25 which jet the three color inks. The purge cap 10, the switching device 11, and the suction pump 12 form part of a recovery mechanism according to the present invention.

Figure 2:
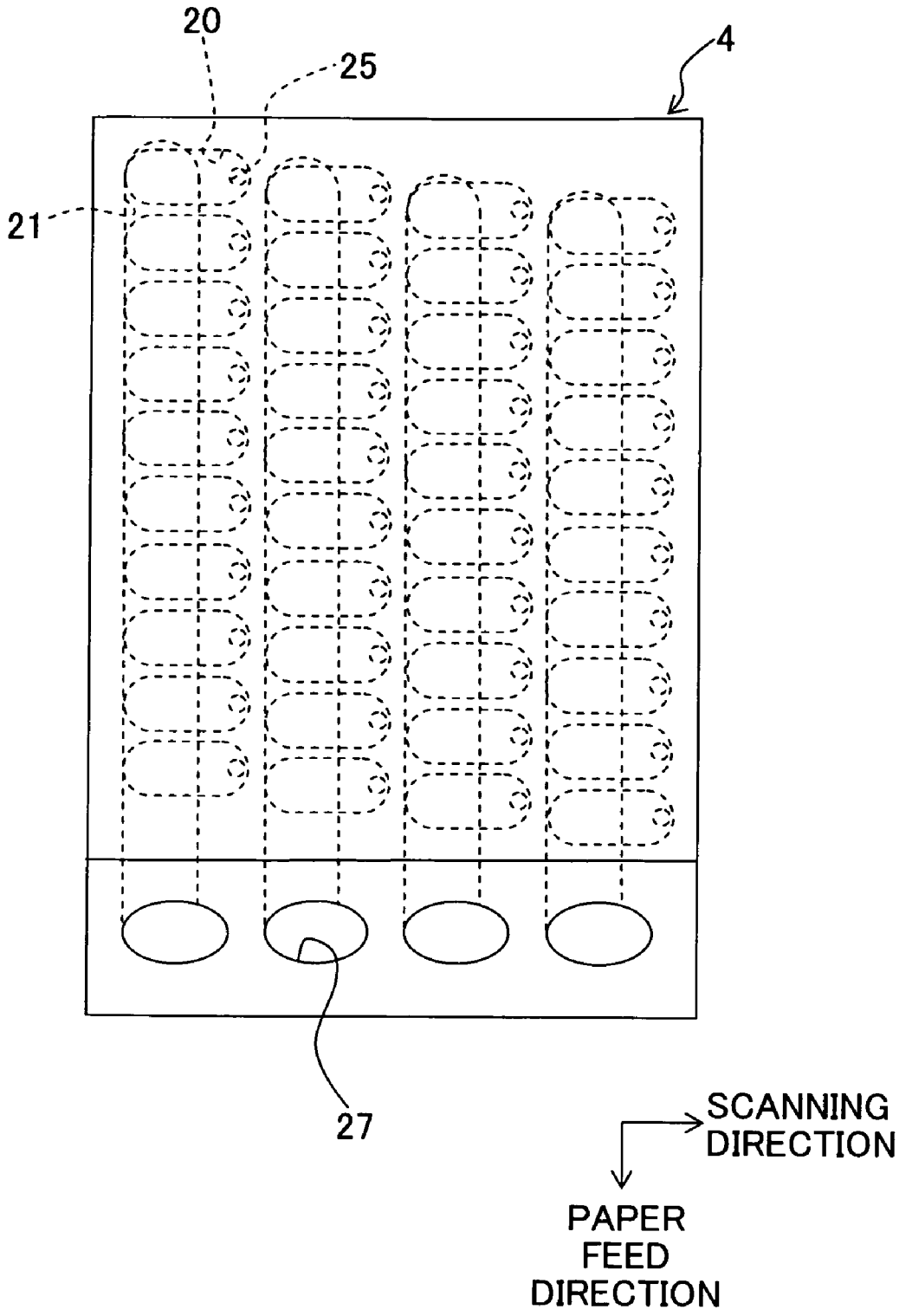
FIG. 2 is a plane view of an inkjet head in FIG. 1.

FIG. 2 shows an example of the inkjet head 4. Similarly to a generally known inkjet head, the inkjet head 4 has, on its lower surface facing the recording paper P, a large number of the nozzles 25 arranged in rows corresponding to the black, yellow, cyan, and magenta inks respectively, and the nozzles 25 in each row communicate with a manifold channel 21, which is provided for each of the inks, via pressure chambers 20. Each of the manifold channels 21 has, at one end thereof, a supply port 27 communicating with the corresponding sub-tank 5 and distributes the ink supplied from the sub-tank 5 to the pressure chambers 20. The ink in the pressure chambers 20 is jetted in liquid droplet form onto the recording paper P from the nozzles 25 when jetting energy is applied thereto. As an application unit of the discharge energy, a unit which deforms piezoelectric elements, a unit which foams the ink by a heater, or the like is usable.

In the inkjet head 4, the nozzles 25 of the three color inks and parts involved in the jetting of the three color inks correspond to a first liquid jetting head according to the present invention, and the nozzles 25 of the black ink and parts involved in the jetting of the black ink correspond to a second liquid jetting head according to the present invention.

Figure 4:
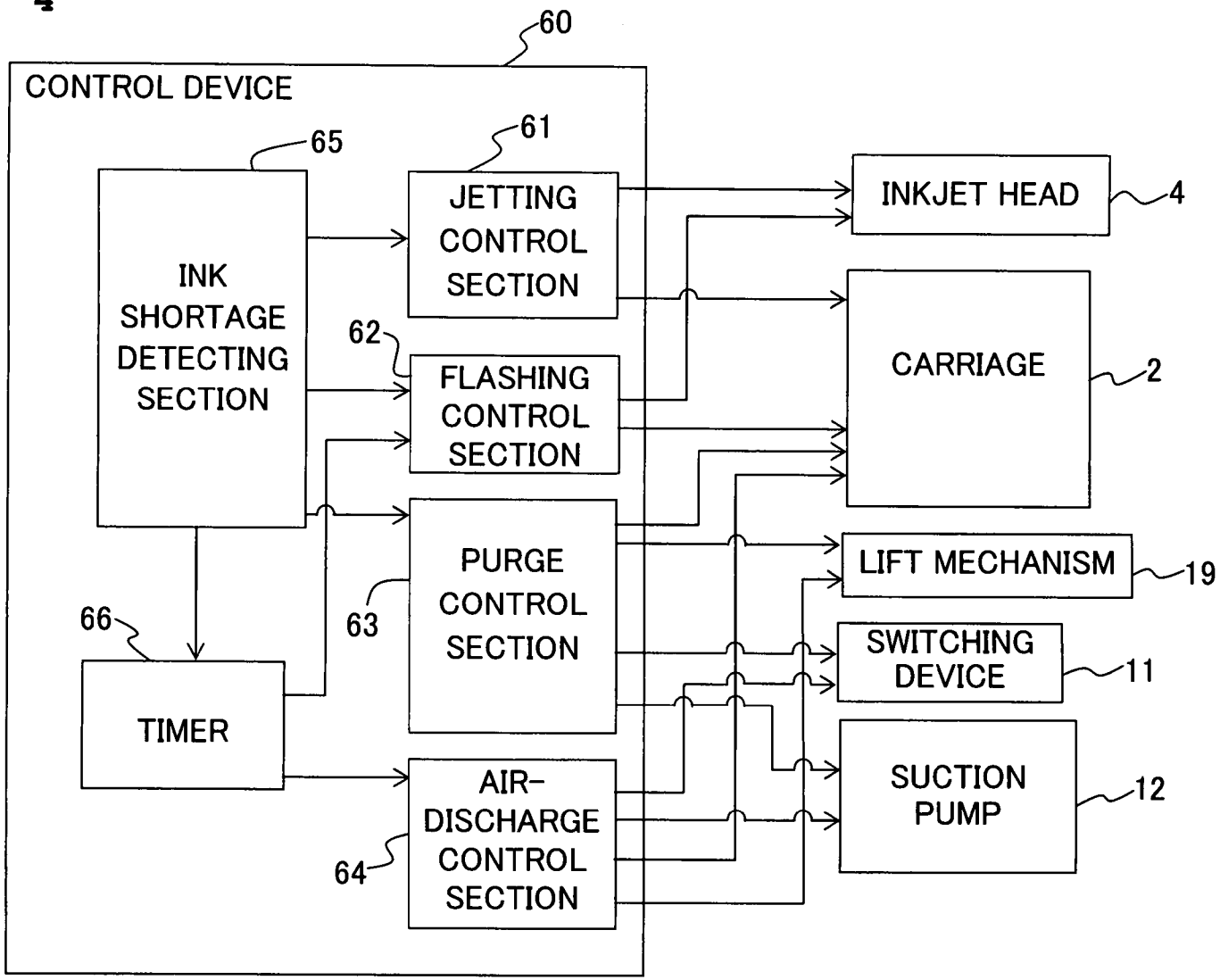
FIG. 4 is a block diagram of a control device in FIG. 1.

Next, the control device 60 controlling the operation of the printer 1 will be explained. FIG. 4 is a block diagram schematically showing the control device 60. The control device 60 includes a CPU (Central Processing Unit), a ROM (Read Only Memory), a RAM (Random Access Memory), and so on, and they operate as a jetting control section 61, a flashing control section 62, a purge control section 63, an air-discharge control section 64, an ink shortage detecting section 65, and a timer 66.

The jetting control section 61 controls the inkjet head 4, the carriage 2, and the paper feed roller 9 based on user data regarding printing or the like. The flashing control section 62 controls the inkjet head 4 and the carriage 2 at the time of the flashing operation.

The purge control section 63 controls the carriage 2, the switching device 11, the suction pump 12, and the lift mechanism 19 at the time of the purge operation. The air-discharge control section 64 controls the carriage 2, the switching device 11, the suction pump 12, and the lift mechanism 19 at the time of the air-discharge in the sub-tanks 5.

The ink shortage detecting section 65 detects an amount of the ink in each of the ink cartridges 14*a* to 14*d* based on a signal or the like of a known sensor (not shown) provided in the printer 1, and outputs a signal indicating the detection result to the jetting control section 61, the flashing control section 62, the purge control section 63, and the timer 66.

The timer 66 measures, that is, detects a time period since a time at which the ink shortage detecting section 65 has detected the ink shortage (an amount of the ink is equal to or less than a predetermined value) of one of the ink cartridges 14*a* to 14*d* up to a time at which the ink shortage detecting section 65 no longer detects that an amount of the ink is equal to or less than the predetermined value after the ink cartridge is replaced or the ink is refilled in the ink cartridge, and outputs a signal indicating the detected time period to the flashing control section 62 and the purge control section 63. Incidentally, a cartridge sensor (not shown) such as a known switch or sensor may detect that the ink cartridge exists and the timer 66 may detect the time period up to the time at which the ink shortage detecting section 65 detects that an amount of the ink is more than the predetermined value.

While the ink shortage detecting section 65 detects that amounts of the inks in the ink cartridges 14*a* to 14*d* are large enough for the execution of the printing operation, the purge operation, and so on, the jetting control section 61 executes the printing operation on the recording paper P by using the black, yellow, cyan, and magenta inks. Further, as is generally known, the flashing control section 62, the purge control section 63, and the air-discharge control section 64 execute the flashing operation, the purge operation, and the air-discharge operation, at a predetermined cycle, artificially when a printing failure occurs, or based on the elapsed time from the latest flashing, purge, and air-discharge operations. The predetermined cycle and the elapsed time may be replaced by a printing data amount such as the number of dots, or the combination of the time and the printing data amount can be used. Hereinafter, timings when these regular recovery operations are executed are simply referred to as a "predetermined cycle" as a general term.

Figure 5A:
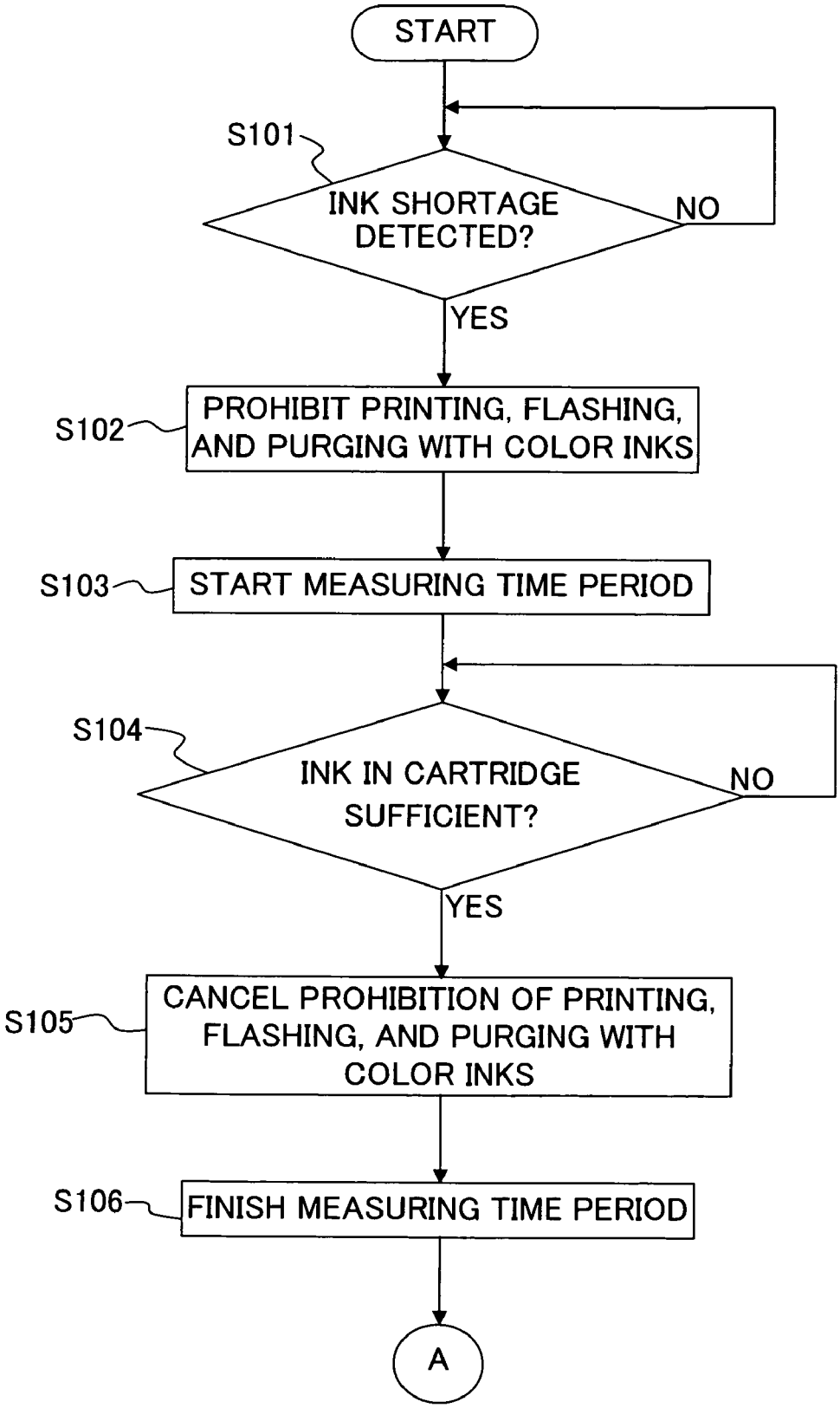
FIGS. 5A and 5B are a flowchart showing an essential part of a control flow.
Figure 5B:
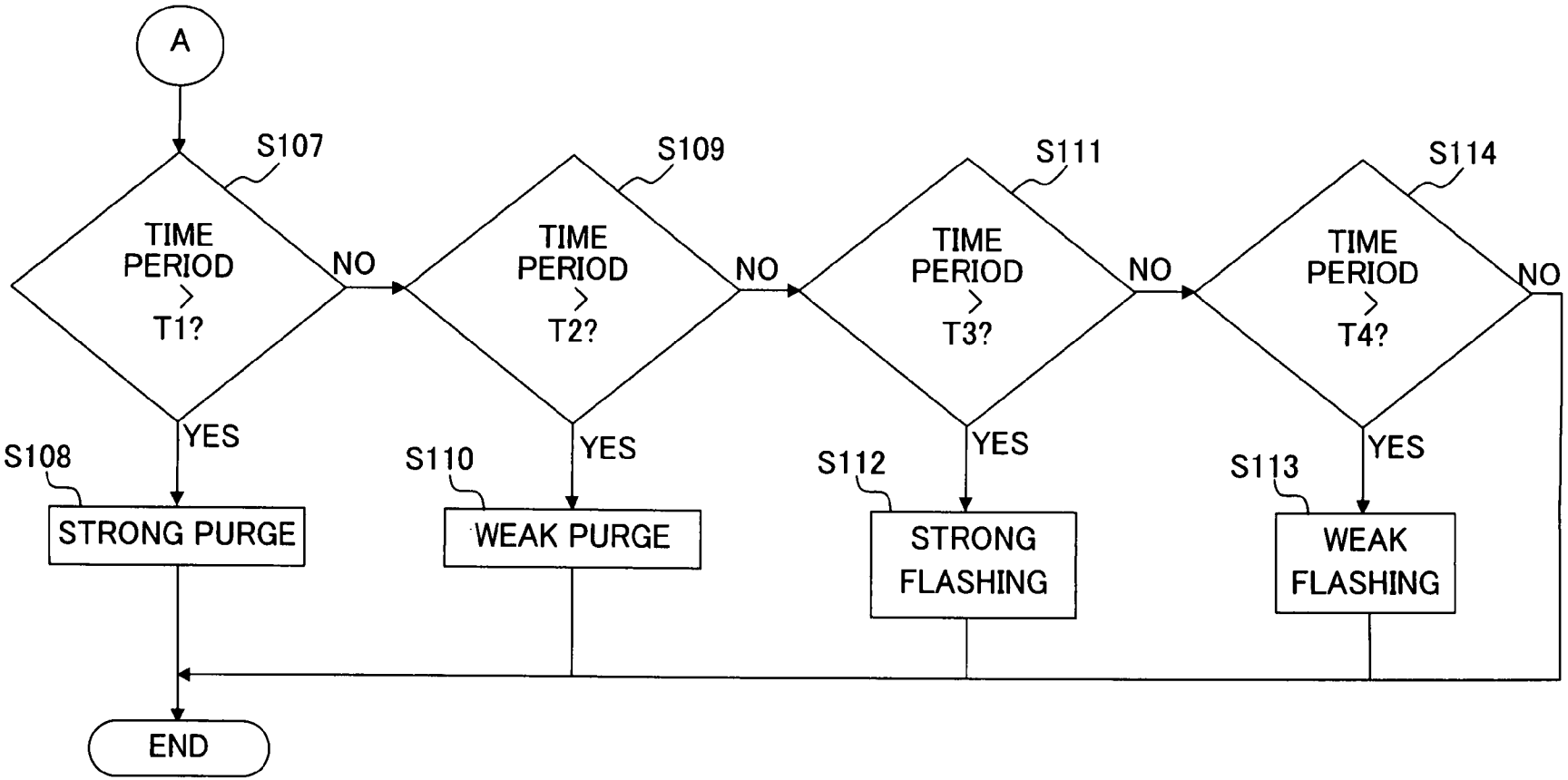

Hereinafter, a control flow of the recovery operation of the nozzles 25 after the ink shortage is detected will be explained with reference to FIG. 5. When the ink shortage detecting section 65 detects the ink shortage of one of the ink cartridges 14*b* to 14*d* of the three color inks (S101 in FIG. 5: YES), based on a signal output from the ink shortage detecting section 65 and indicating the ink shortage, the jetting control section 61 prohibits the printing using the three color inks and the flashing control section 62 and the purge control section 63 prohibit the flashing and purge operations of the nozzles 25 of the three color inks even if the predetermined cycle is reached as described above (S102). Further, based on the detection of the ink shortage, the timer 6 starts measuring the time period (S103).

At this time, the jetting control section 61 does not prohibit the printing using the black ink so that monochrome printing is performed irrespective of whether or not the ink shortage has occurred in any of the ink cartridges 14*b* to 14*d* of the color inks. The flashing control section 62 is capable of executing the flashing operation of only the nozzles 25 jetting the black ink when the predetermined cycle is reached as described above. Further, when the predetermined cycle is reached as described above, the purge control section 63 brings the cap 10 into close contact with the inkjet head 4 and connects the second capping part 10*b* to the suction pump 12 by the switching device 11, to execute the purge operation only of the nozzles 25 jetting the black ink. In this manner, even if the ink shortage occurs in any of the ink cartridges 14*b* to 14*d* of the color inks, the monochrome printing can be performed in the printer 1, which offers higher convenience to a user.

Then, after the ink cartridge in which the ink shortage occurred, among the ink cartridges 14*b* to 14*d*, is replaced or the ink is refilled in the ink cartridge (S104: YES), and when the ink shortage detecting section 65 detects that amounts of these inks are again greater than the predetermined value, the prohibition of the printing using the three color inks and the prohibition of the flashing and purge operations for the nozzles 25 of these color inks are cancelled (S105). Then, the timer 66 finishes the measurement of the time period (S106).

Here, based on the time period measured by the timer 66, the purge operation with respect to the nozzles 25 jetting the three color inks or the flashing operation from these nozzles 25 is controlled. In the purge operation, the purge control section 63 controls the switching device 11, the suction pump 12, and the lift mechanism 19 to make the cap 10 come into close contact with the inkjet head 4 and to connect the first capping part 10*a* to the suction pump 12 by the switching device 11, so that the inks are sucked out from the nozzles 25 jetting the three color inks.

When the time period detected by the timer 66 is longer than a predetermined time period T1 (S107: YES), the purge control section 63 controls the suction pump 12 to execute a purge operation with a high suction effect (strong purge) (S108). When the time period detected by the timer 66 is equal to or shorter than the time period T1 (S107: NO) and is longer than a time period T2 (<T1) (S109: YES), the purge control section 63 controls the suction pump 12 to execute a purge operation with a smaller suction effect (weak purge) than that of the strong purge (S110).

When the time period detected by the timer 66 is equal to or shorter than the time period T2 (S109: NO) and is longer than a time period T3 (<T2) (S111: YES), the flashing control section 62 controls inkjet head 4 to execute a flashing operation with a large ink jetting effect (strong flashing) (S112). When the time period detected by the timer 66 is equal to or shorter than the time period T3 (S111: NO) and is longer than a time period T4 (<T3) (S114: YES), the flashing control section 62 controls the inkjet head 4 to execute a flashing operation with a smaller ink jetting effect (weak flashing) than that of the strong flashing (S113). When the time period detected by the timer 66 is equal to or shorter than the time period T4 (S114: NO), neither the purge operation nor the flashing operation is performed.

The aforesaid strong purge and weak purge can be controlled by the rotation speed, rotation time, or selection of intermittent or continuous rotation of a motor which drives the suction pump 12. Further, the strong flashing and the weak flashing can be controlled by pulse width, voltage, the number of pulses, or the like of a pulse waveform which drives the inkjet head 4. The strong/weak control may be performed in three stages or more. Further, only the purge operation or the flashing operation may be performed after the replacement of the ink cartridge.

In the above-described manner, the inks in the nozzles 25 are prevented from increasing in viscosity during a period before the ink shortage of the ink cartridges 14*b* to 14*d* is solved, and thereafter, the printer 1 returns to the regular operation.

Incidentally, when the ink shortage of the ink cartridges 14*b* to 14*d* is solved, the purge operation or the flashing operation is performed in the above-described manner, and in addition, the air-discharge control section 64 controls the lift mechanism 19 to make the air-discharge cap 8 come into close contact with the lower end openings 7*a* of the air-discharge channels 7. When the valves 17 are opened, the air-discharge control section 64 controls the switching device 11 and the suction pump 12 to connect the suction pump 12 to the air-discharge channels 7, and the suction pump 12 is driven to appropriately suck air in the upper spaces in the sub-tanks 5, so that the air is discharged to the outside.

If the printing using the black ink is continued even after the ink shortage occurs in one of the ink cartridges 14*b* to 14*d* of the three color inks as described above, in an apparatus where the nozzles of the black ink and the three color inks are integrally disposed on the carriage 2 as in this embodiment, the nozzles of the three color inks are exposed to a non-jetting state, that is, a dry state. Further, it is expected that a user using a large amount of the black ink will continue to use the apparatus for a long time without replacing the color ink cartridges, which may possibly promote the viscosity increase of the inks in the nozzles of the three color inks.

Further, if the flashing operation and the purge operation with respect to the nozzles of the three color inks are continued, since air is led from the empty ink cartridge into the inkjet head 4, a large amount of the ink to be discharged wastefully is necessary for recovering the function of the inkjet head 4 after the replacement of the ink cartridges 14*b* to 14*d* for the color inks. However, in this embodiment, when the ink shortage occurs in any of the ink cartridges 14*b* to 14*d* for the color inks, the printing operation, the flashing operation, and the purge operation using the color inks are prohibited, which makes it difficult for the air to be led into the inkjet head 4.

On the other hand, when the flashing operation and the purge operation are thus prohibited, the viscosity increase of the inks progresses in the nozzles of the three color inks with time, and therefore, if the recovery operation is indiscriminatingly performed when the ink cartridges 14*b* to 14*d* are replaced, there is a risk that the color ink may be discharged more than necessary or, conversely, the viscosity increase of the color ink in the inkjet head 4 is not fully solved. However, in this embodiment, after the ink cartridges 14*b* to 14*d* are replaced, one of the flashing operation and the purge operation is performed and further the strength of the flashing operation and the purge operation is changed, based on the time period detected by the timer 66, which can surely solve the viscosity increase of the inks in the inkjet head 4 and can prevent the discharge of the inks more than necessary.

In this embodiment, the printer 1 may include a cap (not shown in the diagram) which covers the nozzles 25 of the inkjet head 4, when both of the black ink and the color inks are not discharged, to prevent the nozzles 25 from being dried. Further, the timer 66 may measure time periods during which the monochrome printings are performed, that is, time periods during which the nozzles 25 of the three color inks were not covered with the cap, since the time at which the ink shortage detecting section 65 has detected the ink shortage of one of the color ink cartridges 14*b* to 14*d* up to the time at which the ink shortage detecting section 65 no longer detects the ink shortage of the color ink cartridge.

Next, a preferable second embodiment of the present invention will be explained. The second embodiment has the same structure as that of the first embodiment except that a control device which controls the operation of the printer 1 (see FIG. 1) is different from the control device 60 (see FIG. 4) of the first embodiment, and therefore, only what are different from the first embodiment will be explained and the explanation of the other points will be omitted when appropriate.

Figure 6:
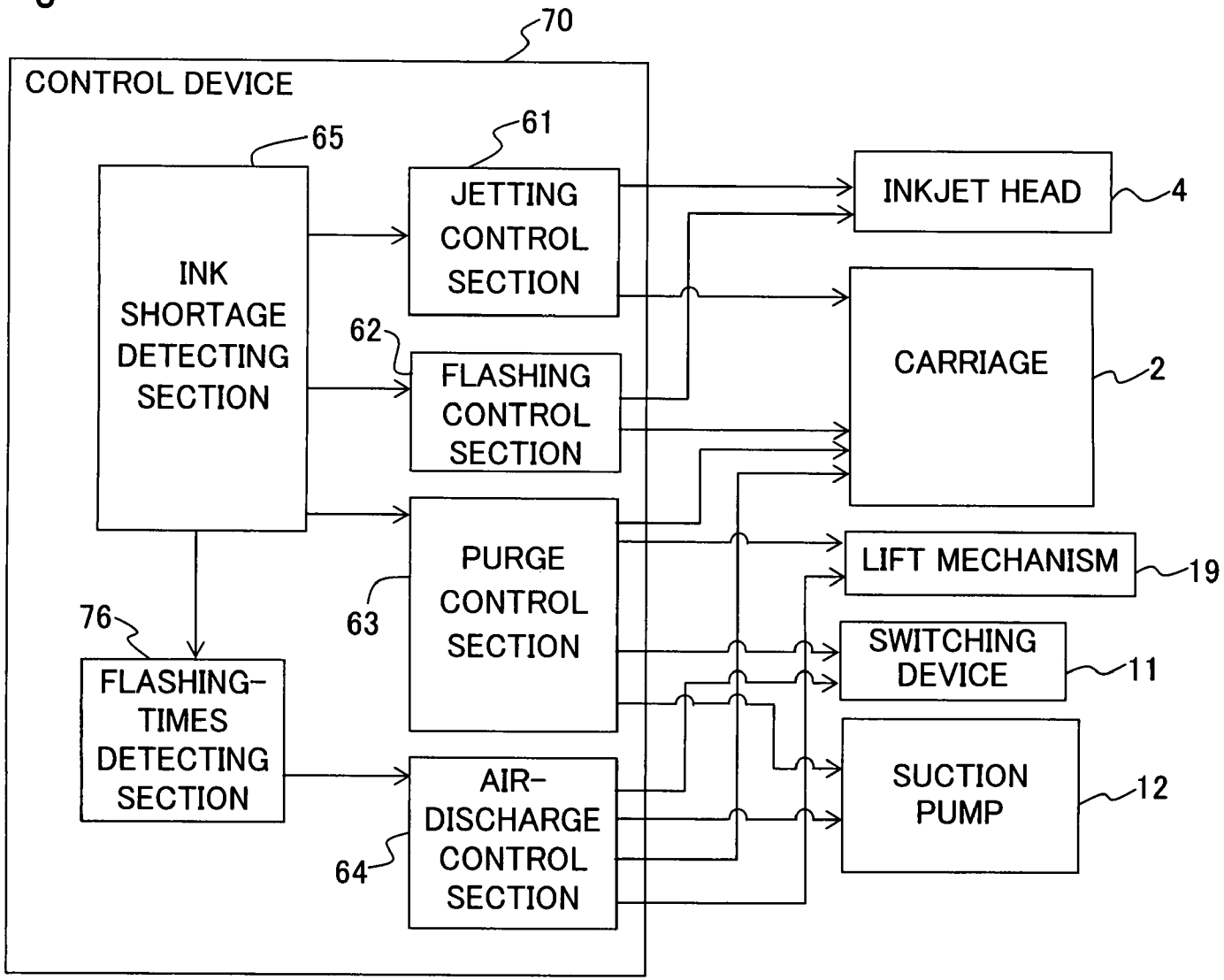
FIG. 6 is a block diagram of a second embodiment, corresponding to FIG. 4.

FIG. 6 is a block diagram of a control device 70 (controller) which controls the printer 1 in the second embodiment. The control device 70 includes a CPU, a ROM, a RAM, and so on, which operate as a jetting control section 61, a flashing control section 62, a purge control section 63, an air-discharge control section 64, an ink shortage detecting section 65, and a flashing-times detecting section 76.

In the second embodiment, when the ink shortage detecting section 65 detects that ink shortage has occurred in any of the ink cartridges 14*b* to 14*d* of three color inks, the jetting control section 61 controls the inkjet head 4 to prohibit printing using the three color inks, but the flashing control section 62 controls the inkjet head 4 to continue the flashing operation of the three color inks, thereby suppressing the viscosity increase of the inks in the nozzles 25. Therefore, the ink shortage detecting section 65 is set to detect the ink shortage at a time at which there still remains the ink in an amount large enough for the flashing operation to be performed a small number of times. Here, an amount of the ink discharged by the flashing operation is smaller than an amount of the ink discharged by the purge operation.

When receiving, from the ink shortage detecting section 65, a signal indicating the ink shortage has occurred in any of the ink cartridges 14*b* to 14*d* of the three color inks, the flashing-times detecting section 76 starts counting the number of times the flashing operation of the color ink is performed and continues counting the number of times the flashing operation of the color ink is performed until the ink shortage detecting section 65 detects that an amount of the ink in the relevant ink cartridge, among the ink cartridges 14*b* to 14*d*, is again equal to or larger than a predetermined value.

In the second embodiment as in the first embodiment described above, when amounts of the inks in the ink cartridges 14*a* to 14*d* are sufficient, the jetting control section 61 controls the inkjet head 4 to execute the printing operation by using the black, yellow, cyan, and magenta inks. Further, the flashing control section 62, the purge control section 63, and the air-discharge control section 64 execute the flashing, purge, and air-discharge operations respectively when a predetermined cycle is reached.

Figure 7A:
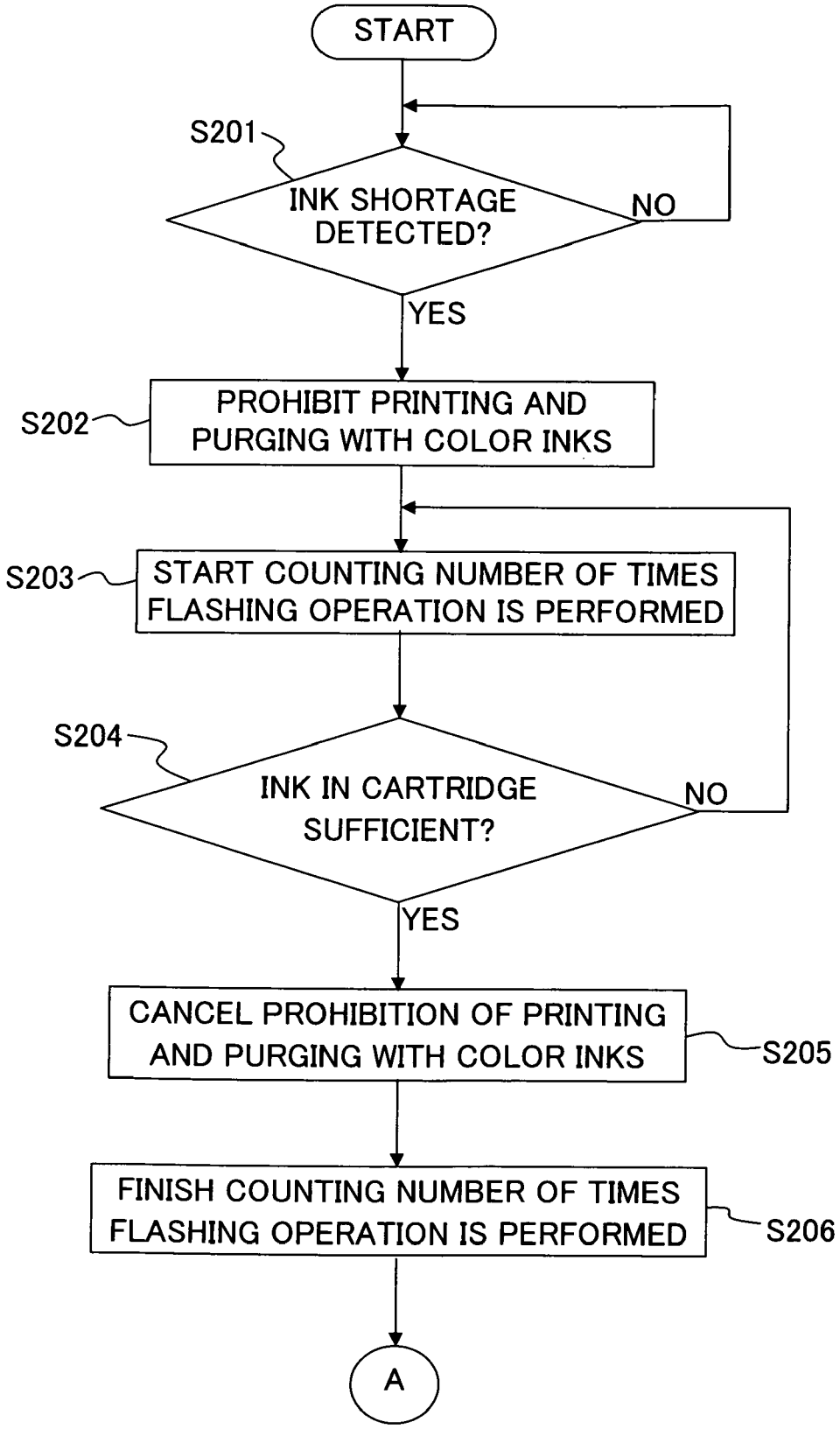
FIGS. 7A and 7B are a flowchart of the second embodiment, corresponding to FIGS. 5A and 5B.

At S201 and S202 in FIG. 7A similar to S101 and S102 of the above-described first embodiment, when the ink shortage of any of the ink cartridges 14*b* to 14*d* is detected (S201: YES), the jetting control section 61 controls the inkjet head 4 to permit the printing with the black ink and to prohibit the printing with the three color inks. Further, the purge control section 63 controls the suction pump 12 to permit the purge operation of the nozzles 25 of the black ink and to prohibit the purge operation of the nozzles 25 of the three color inks when the predetermined cycle is reached. In the second embodiment, the flashing control section 62 controls the inkjet head 4 to permit the flashing operation of the nozzles 25 of the black ink and the three color inks and to execute the flashing operation when the predetermined cycle is reached. Further, based on the detection of the ink shortage, the flashing-times detecting section 76 starts counting the number of times the flashing operation of the nozzles 25 of the three color inks is performed (S203).

Then, when the ink shortage detecting section 65 detects that amounts of these inks are again equal to or larger than the predetermined value after the ink cartridge in which the ink shortage has occurred, among the ink cartridges 14*b* to 14*d*, is replaced, or the ink is refilled in the ink cartridge (S204: YES), the prohibition of the printing and the purge operation using the three color inks is cancelled (S205). Then, the flashing-times detecting section 76 finishes counting the number of times the flashing operation is performed (S206).

If the printing with the black ink is continued while the printing with the three color inks is prohibited as explained in the above first embodiment, the nozzles 25 of the three color inks are exposed to the dry state, but in the second embodiment, the flashing operation with respect to the nozzles 25 of the three color inks is permitted. This can prevent nozzle clogging due to viscosity increase of the inks, but when the ink cartridges become empty due to ink consumption by the flashing operation, air is led into the sub-tanks 5 through the tubes 6. When this air increases in volume to flow into the inkjet head 4, a printing failure occurs. In the second embodiment, since the number of times the flashing operation is performed, which is detected by the flashing-times detecting section 76, is thought to correspond to an amount of the air led into the sub-tanks 5, the air-discharge operation from the sub-tanks 5 is controlled based on the number of times the flashing operation is performed.

As in the first embodiment, the air-discharge operation is performed in such a manner that, the air-discharge control section 64 controls the lift mechanism 19 to make the air-discharge cap 8 come into close contact with the lower end openings 7*a* of the air-discharge channels 7 to open the valves 17, and while the suction pump 12 is connected to the air-discharge channels 7 by the switching device 11, the suction pump 12 is driven to suck air in the upper spaces in the sub-tanks 5. An air-discharge amount at this time can be controlled by the combination of the rotation speed, rotation time, and the selection of intermittent or continuous rotation, and so on of the motor which drives the suction pump 12.

Even if the air-discharge operation of the sub-tanks other than the sub-tank 5 communicating with the replaced ink cartridge is simultaneously performed, an amount of the ink discharged by the air-discharge operation is only a little, and there is no practical problem. Preferably, by individually controlling the projections 8*a* in the air-discharge cap 8, the air-discharge operation may be performed while only the valve 17, of the air-discharge channel 7 of the sub-tank 5 which communicates with the replaced ink cartridge, is opened.

Figure 7B:
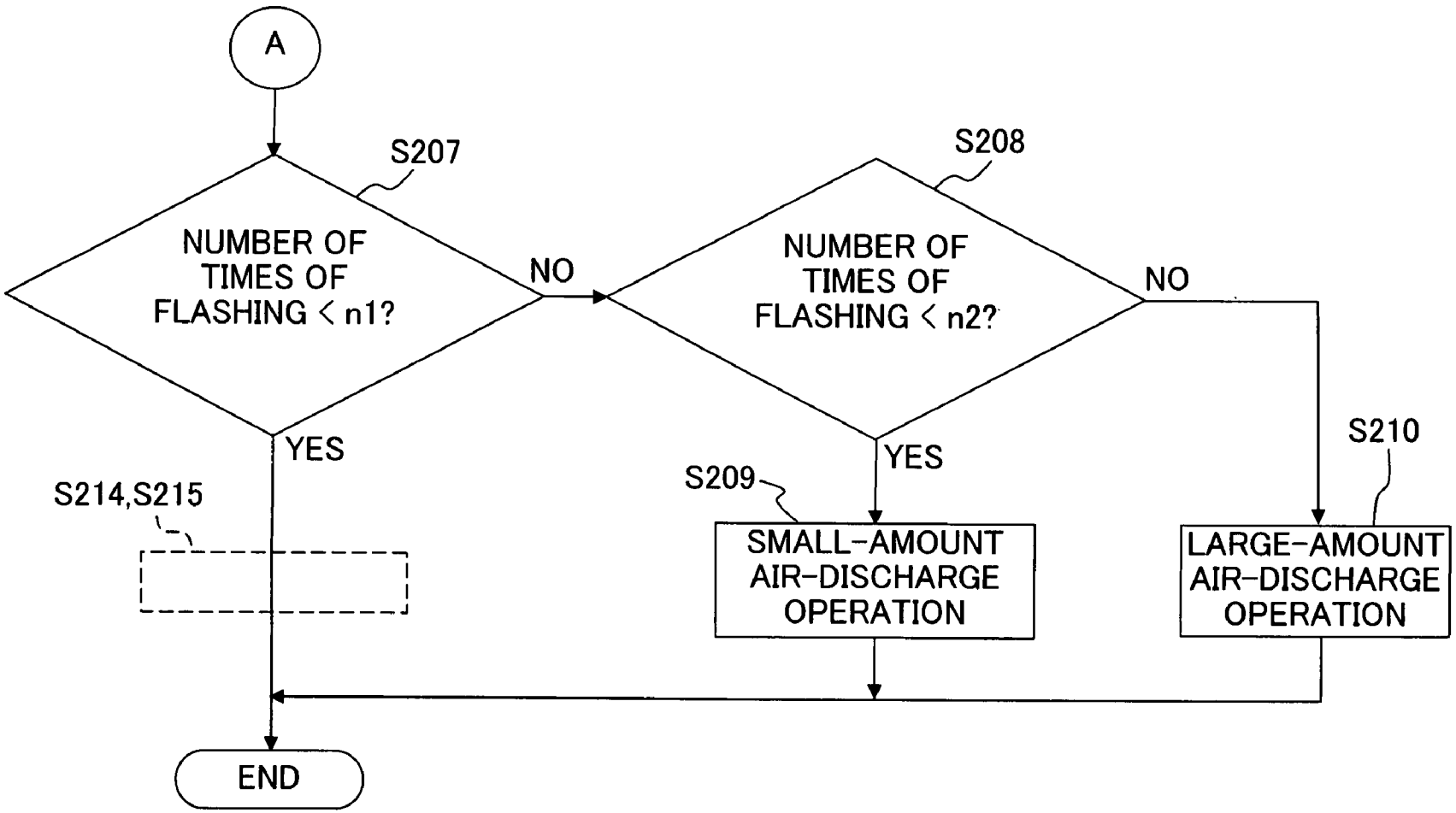

Let us return to the explanation of the flowchart in FIG. 7B. When the number of times the flashing operation is performed is smaller than a predetermined value n1 (S207: YES), the ink cartridge 14 has not yet been empty or the air from the ink cartridge 14 has not reached the sub-tank 5, and therefore, the process is finished without any air-discharge operation.

When the number of times the flashing operation is performed is equal to or larger than the predetermined value n1 (S207: NO) and is smaller than a predetermined value n2 (>n1) (S208: YES), the air has been led into the sub-tank 5 but its amount is a little, and therefore, only a small-amount air-discharge operation is executed (S209).

When the number of times the flashing operation is performed is equal to or larger than the predetermined value n2 (S208: NO), an amount of the air led into the sub-tank 5 is large, and therefore, an air-discharge operation with a larger amount than the air-discharge amount at S209 is executed (S210). Then, the printer 1 returns to the regular operation. Incidentally, a relation between the numbers of times n1, n2 the flashing operation is performed and the amount of the air led into the sub-tanks 5 is decided in advance based on an experiment or the like based on the capacity of the sub-tank 5 and the tube 6.

As described above, if the printing with the black ink is continued after the ink shortage occurs in any of the ink cartridges 14*b* to 14*d* of the three color inks, there is a risk that the inks may greatly increase in viscosity in the nozzles 25 of the three color inks. However, in this embodiment, the flashing operation of the nozzles 25 of the three color inks is continuously performed even if the ink shortage occurs in any of the ink cartridges 14*b* to 14*d*, which can suppress the viscosity increase of the inks in the nozzles 25 of the three color inks. At this time, an amount of the inks jetted from the nozzles 25 by the flashing operation is smaller than that by the purge operation, and therefore, an amount of the air led in by the flashing operation is relatively small.

Further, an amount of the air led into the sub-tank 5 from the ink cartridge which has become empty by the ink consumption accompanying the flashing operation is thought to correspond to the number of times the flashing operation is performed, and therefore, by controlling the air-discharge operation, that is, an air-discharge amount, based on the number of times the flashing operation is performed, it is possible to appropriately discharge the air in the sub-tank 5.

Figure 8A:
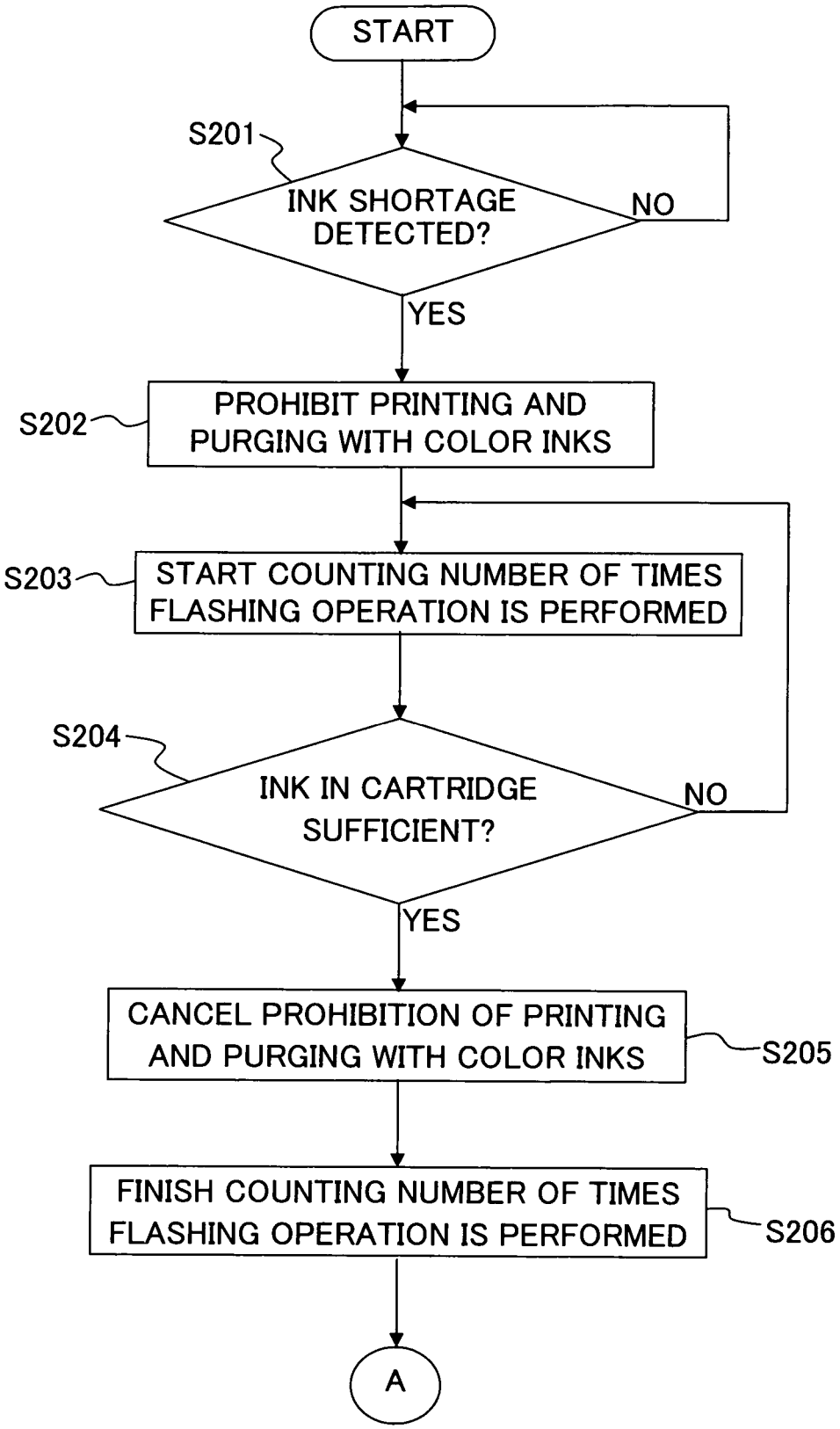
FIGS. 8A and 8B are a flowchart of a third embodiment, corresponding to FIGS. 5A and 5B.
Figure 8B:
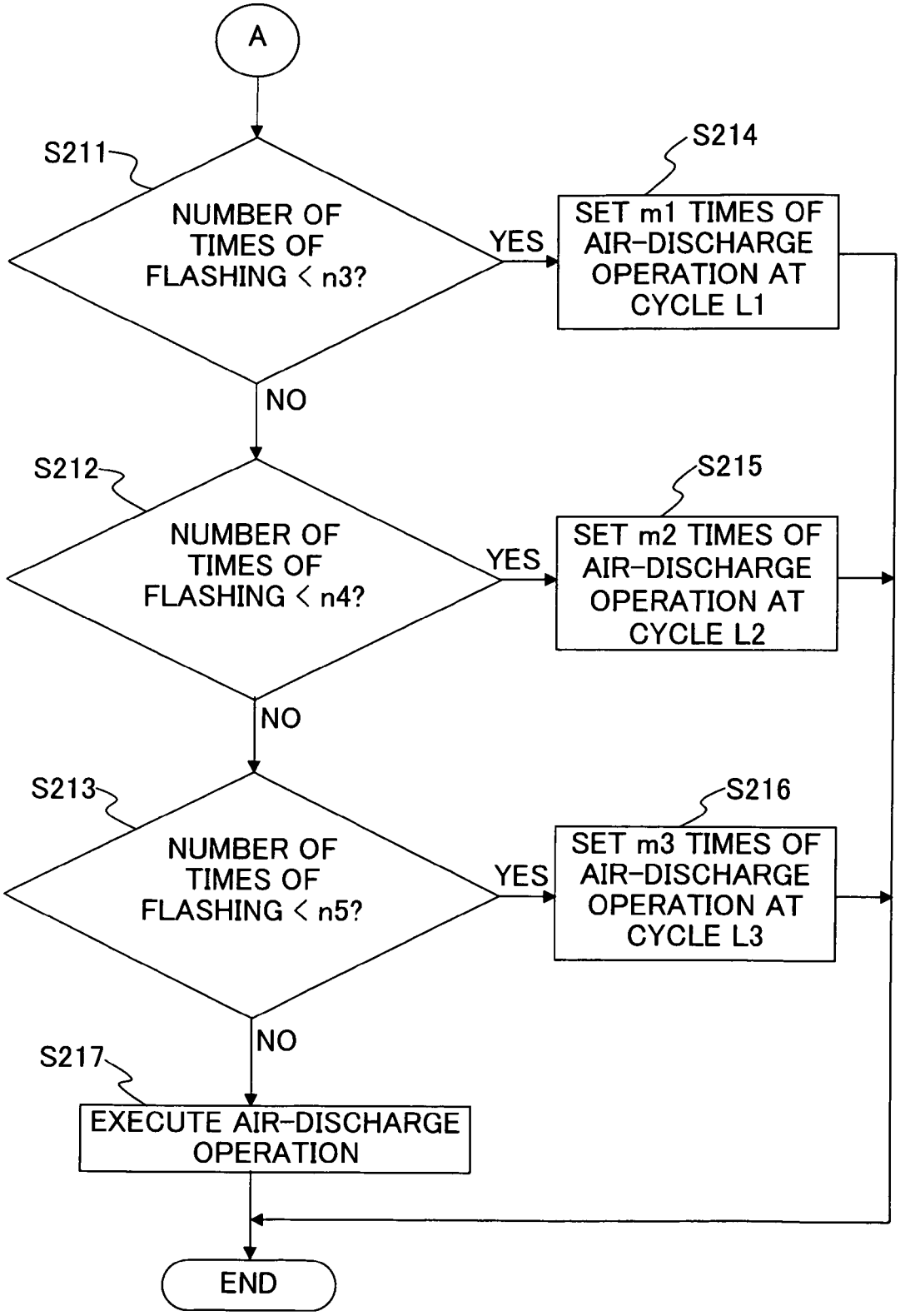

FIGS. 8A and 8B show a third embodiment in which part of the second embodiment is modified, and S201 to S206 are the same as those in the second embodiment.

Air dissolved in the inks or air permeating wall surfaces of the tubes 6 to be dissolved in the inks grows into air bubbles in the sub-tanks 5 to be accumulated in the upper portions of the sub-tanks 5. Normally, this air is discharged to the outside by the above-described air-discharge operation when the predetermined cycle is reached. In the third embodiment, based on an amount of the air which is led in by the flashing operation permitted after the ink shortage in the second embodiment, a cycle L of a regular air-discharge operation is changed in executing the air-discharge operation.

At S211 in FIG. 8B, the judgment regarding the number of times the flashing operation is performed is made same as at S207 in FIG. 7B, but n3 may be different from n1 in FIG. 7B. When the number of times the flashing operation is performed is smaller than the predetermined value n3 (S211: YES), even before air from the ink cartridge which was used before the replacement is led in, m1 times of the air-discharge operation is set at a cycle L1 (S214) by estimating the time when air in a connection portion between the ink cartridge 14 and the tube 6 reaches the sub-tank 5, because the air unavoidably enters the connection portion at the time of the replacement of the ink cartridge 14. The cycle L1 is shorter than the cycle L of the regular air-discharge operation (L1<L). That is, as will be described later, by performing the air-discharge operation m1 times (for example, a plurality of times) at a cycle shorter than the cycle of the regular air-discharge operation after the printer 1 returns to the regular printing operation, it is possible to quicken the time when the aforesaid air reaches the sub-tank 5 to prevent its growth in the tube 6 and efficiently discharge the air.

When the number of times the flashing operation is performed is equal to or larger than the predetermined value n3 (S211: NO) and is smaller than a predetermined value n4 (>n3) (S212: YES), m2 times of the air-discharge operation at a cycle L2 (<L1) is set (S215) since the air has been led from the empty ink cartridge into the tube 6. Here, m2 may be set as m2=m1, or m2 (<m1) times of the air-discharge operation may be set at the cycle L2=L1.

When the number of times the flashing operation is performed is equal to or larger than the predetermined value n4 (S212: NO) and is smaller than a predetermined value n5 (>n4) (S213: YES), m3 times of the air-discharge operation at a cycle L3 (<L2) are set (S216) since a relatively small amount of air has been led into the sub-tank 5. Here, m3 may be set as m3=m2, or m3 (<m2) times of the discharge operation may be set at the cycle L3=L2.

When the number of times the flashing operation is performed is equal to or larger than the predetermined value n5 (S213: NO), the air-discharge operation is immediately executed (S217) since an amount of the air in the sub-tank is large.

Then, the printer 1 returns to the regular printing operation, and the air-discharge operation is executed m1 times, m2 times, or m3 times at the corresponding cycle every time the aforesaid predetermined cycle L1, L2, or L3 is reached. After the air-discharge operation is executed the set number of times at the set cycle, the set cycle and the set number of times are returned to original values.

When the cycle L of the regular air-discharge operation is longer than the aforesaid cycle L1 depending on the setting of the capacity of the tube 6 and so on, such setting may be made that the air-discharge operation to be executed first after the printer 1 returns to the regular printing operation is performed once at a shorter interval (that is, cycle) than the cycle L from the latest air-discharge operation. At S214, S215, and S216, the cycles L1, L2, L3 are set as L1>L2>L3.

In setting the aforesaid cycles L1, L2, L3, an amount of the led-in air can be taken into consideration in addition to an amount of the accumulated air in the sub-tank 5 accumulated by the regular air-discharge operation at the cycle L.

In the second embodiment, when the number of times the flashing operation is performed is smaller than the predetermined value n1 (S207: YES), the cycle and the number of times of the air-discharge operation may be set based on the number of times the flashing operation is performed, same as the steps S214 and S215 of the third embodiment. Further, in the third embodiment, when the number of times the flashing operation is performed is equal to or larger than the predetermined value n5 (S213: NO), the air-discharge amount in the air-discharge operation may be changed based on the number of times the flashing operation is performed, same as S209 and S210 of the second embodiment.

Incidentally, in the embodiments, the first liquid jetting head jetting the three color inks and the second liquid jetting head jetting the black ink are integrally formed as the inkjet head 4, but these jetting heads may be separately provided.

Further, with the head which jets the black ink being defined as the first liquid jetting head and the head which jets the three color inks being defined as the second liquid jetting head, the printing with the three color inks may be continued when the shortage of the black ink occurs.

Further, when liquid jetting heads of three kinds or more are provided, such structure can be adopted that the combination of any jetting heads including the jetting head having the ink shortage is defined as the first liquid jetting head and the combination of the remaining jetting heads is defined as the second liquid jetting head, and the combination is changed depending on which jetting head has the ink shortage among the liquid jetting heads of three kinds or more.

Further, the present invention is applicable not only to an apparatus jetting ink but also to an apparatus jetting any of various kinds of liquids such as an apparatus applying colorants of two kinds or more on a medium in a pattern form.

Further, in the embodiments, as "purge operation" and "air-discharge operation", the operation of sucking the inks from the nozzles 25 or sucking air from the sub-tanks 5 by the operation of the suction pump 12 is performed, but an operation of pushing out the inks from the nozzles 25 or pushing out the air from the sub-tanks 5 may be performed by applying positive pressure to the inks from an upstream side of the sub-tanks.

Further, the recovery operation based on the time period measured by the timer or the air-discharge operation based on the number of times the flashing operation is performed can be arbitrarily changed. For example, they may be performed in more stages than those explained in the embodiments.

What is claimed is:

1. A liquid jetting apparatus comprising:

a first liquid jetting head having a nozzle which jets a first liquid supplied from a first liquid supply source storing the first liquid;

a second liquid jetting head having a nozzle which jets a second liquid supplied from a second liquid supply source storing the second liquid;

a liquid shortage detecting section detecting shortage of the first liquid in the first liquid supply source;

a state detecting section which detects a state of the first liquid jetting head since a time at which the shortage of the first liquid has been detected by the liquid shortage detecting section up to a time at which the shortage of the first liquid is solved;

a recovery mechanism which performs a recovery operation of the first liquid jetting head and the second liquid jetting head; and a controller which controls the first liquid jetting head, the second liquid jetting head, and the recovery mechanism, wherein the controller controls the second liquid jetting head to jet the second liquid irrespective of a detection result of the shortage of the first liquid by the liquid shortage detecting section;

the controller controls the first liquid jetting head to restrict the jetting of the first liquid by the first liquid jetting head and controls the recovery mechanism to restrict the recovery operation with respect to the first liquid jetting head since the time at which the shortage of the first liquid has been detected by the liquid shortage detecting section up to the time at which the shortage of the first liquid is solved; and the controller controls, after the shortage of the first liquid is solved, the recovery mechanism based on the state of the first liquid jetting head, detected by the state detecting section, to perform the recovery operation.

2. The liquid jetting apparatus according to claim 1, wherein the state detecting section is a timer which detects a time period since the time at which the shortage of the first liquid has been detected by the liquid shortage detecting section up to the time at which the shortage of the first liquid is solved;

the recovery mechanism causes the liquids in the first liquid jetting head and the second liquid jetting head to be discharged outside of the first and second liquid jetting heads respectively to prevent a viscosity increase of the liquids in the first liquid jetting head and the second liquid jetting head;

the controller controls the first liquid jetting head to stop jetting of the first liquid by the first liquid jetting head and controls the recovery mechanism to stop the recovery operation of the first liquid jetting head since the time at which the shortage of the first liquid has been detected by the liquid shortage detecting section up to the time at which the shortage of the first liquid is solved; and the controller controls, after the shortage of the first liquid is solved, the recovery mechanism based on the time period detected by the timer to perform the recovery operation.

3. The liquid jetting apparatus according to claim 2, wherein the recovery mechanism performs a purge operation or a flashing operation as the recovery operation, the purge operation being an operation for discharging the first liquid in the first liquid jetting head from the nozzle by changing from outside of the first liquid jetting head a pressure in the first liquid in the first liquid jetting head and the flashing operation being a operation for causing the nozzle to jet the first liquid by driving the first liquid jetting head; and the controller controls the recovery mechanism to perform the purge operation, the flashing operation, or selective combination of the purge operation and the flashing operation, based on the time period detected by the timer.

4. The liquid jetting apparatus according to claim 3, further comprising a carriage to which the first liquid jetting head and the second liquid jetting head are attached and which reciprocates in a predetermined direction and a cap which covers the nozzles of the first liquid jetting head and the nozzles of the second liquid jetting head, when both of the first liquid and the second liquid are not discharged, to prevent the nozzles from being dried.

5. The liquid jetting apparatus according to claim 4, wherein the first liquid jetting head and the second liquid jetting head are integrally formed.

6. The liquid jetting apparatus according to claim 2, wherein the first liquid jetting head is an inkjet head which jets a color ink as the first liquid, and the second liquid jetting head is an inkjet head which jets a black ink as the second liquid.

7. The liquid jetting apparatus according to claim 1, further comprising:

a first connection channel which connects the first liquid supply source and the first liquid jetting head; and a second connection channel which connects the second liquid supply source and the second liquid jetting head, wherein the recovery mechanism has an air-discharge mechanism which discharges gas in the first connection channel to outside of the first connection channel;

the state detecting section is a flashing-times detecting section which detects a number of times the first liquid jetting head performs a flashing operation, during the period since the time at which the shortage of the first liquid has been detected by the liquid shortage detecting section up to the time at which the shortage of the first liquid is solved, the flashing operation being an operation for jetting the first liquid from the nozzle to prevent a viscosity increase of the first liquid in the nozzle of the first liquid jetting head;

the controller includes: a flashing control section which controls the first liquid jetting head to perform the flashing operation; an air-discharge control section which controls the air-discharge mechanism to discharge the gas in the first connection channel; and a jetting control section which controls the first liquid jetting head and the second liquid jetting head to jet the first and the second liquids respectively, based on user data;

the jetting control section controls the first liquid jetting head to stop the jetting of the first liquid based on the user data and controls the second liquid jetting head to jet the second liquid, during a period since the time at which the shortage of the first liquid has been detected by the liquid shortage detecting section up to the time at which the shortage of the first liquid is solved;

the flashing control section controls the first liquid jetting head to perform the flashing operation during the period since the time at which the shortage of the first liquid has been detected by the liquid detecting unit up to the time at which the shortage of the first liquid is solved; and the air-discharge control section controls, when the shortage of the first liquid is solved, the air-discharge mechanism based on the number of times the flashing operation is performed, detected by the flashing-times detecting section, to discharge the gas in the first connection channel.

8. The liquid jetting apparatus according to claim 7, wherein when the shortage of the first liquid is solved, the air-discharge control section controls the air-discharge mechanism to discharge the gas in an amount which is increased, as the number of times the flashing operation is performed, which is detected by the flashing-times detecting section, becomes greater.

9. The liquid jetting apparatus according to claim 7, wherein when the liquid shortage is not detected by the liquid shortage detecting section, the air-discharge control section controls the air-discharge mechanism to discharge the gas in the first connection channel and the second connection channel at a predetermined air-discharge cycle; and then when the shortage of the first liquid is solved and when the number of times of the flashing operation detected by the flashing-times detecting section is smaller than a predetermined number of times, the air-discharge control section causes the gas in the first connection channel to be discharged to outside of the first connection channel at least once at a cycle shorter than the air-discharge cycle.

10. The liquid jetting apparatus according to claim 7, wherein the first liquid jetting head is an inkjet head which jets a color ink as the first liquid, and the second liquid jetting head is an inkjet head which jets a black ink as the second liquid.

11. A maintenance method of a liquid jetting apparatus including a first liquid supply source storing a first liquid; a first liquid jetting head having a nozzle which jets the first liquid supplied from the first liquid supply source; a second liquid supply source storing a second liquid; a second liquid jetting head having a nozzle which jets the second liquid supplied from the second liquid supply source; a first connection channel connecting the first liquid supply source and the first liquid jetting head; and a second connection channel connecting the second liquid supply source and the second liquid jetting head, the method comprising:

detecting shortage of the first liquid of the first liquid supply source;

restricting a jetting operation of the first liquid jetting head and restricting a recovery operation of the first liquid jetting head;

detecting a state of the first liquid jetting head since a time at which the shortage of the first liquid has been detected up to a time at which the shortage of the first liquid is solved; and performing the recovery operation of the first liquid jetting head based on the detected state of the first liquid jetting head.

12. The maintenance method of the liquid jetting apparatus according to claim 11, wherein the second liquid is jetted from the second liquid jetting head during a period while the jetting operation of the first liquid jetting head and the recovery operation of the first liquid jetting head are restricted.

13. The maintenance method of the liquid jetting apparatus according to claim 12, wherein the state of the first liquid jetting head since the time at which the shortage of the first liquid has been detected up to the time at which the shortage of the first liquid is solved is a time period since the time at which the shortage of the first liquid has been detected up to the time at which the shortage of the first liquid is solved.

14. The maintenance method of the liquid jetting apparatus according to claim 13, wherein the recovery operation of the first liquid jetting head includes a purge operation or a flashing operation, the purge operation being an operation for discharging the first liquid in the first liquid jetting head from the nozzle by changing a pressure from outside of the first liquid jetting head in the first liquid in the first liquid jetting head and the flashing operation being an operation for causing the nozzle to jet the first liquid by driving the first liquid jetting head.

15. The maintenance method of the liquid jetting apparatus according to claim 14, further comprising comparing, with a predetermined time period, the time period since the time at which the shortage of the first liquid has been detected up to the time at which the shortage of the first liquid is solved, wherein the purge operation, the flashing operation, or selective combination of the purge operation and the flashing operation is performed based on a result of the comparison.

16. The maintenance method of the liquid jetting apparatus according to claim 13, wherein the state of the first liquid jetting head since the time at which the shortage of the first liquid has been detected up to the time at which the shortage of the first liquid is solved is a number of times the first liquid jetting head performs a flashing operation since the time at which the shortage of the first liquid has been detected up to the time at which the shortage of the first liquid is solved, the flashing operation being an operation for jetting the first liquid from the nozzle to prevent a viscosity increase of the first liquid in the nozzle of the first liquid jetting head.

17. The maintenance method of the liquid jetting apparatus according to claim 16, wherein the recovery operation of the first liquid jetting head includes an air-discharge operation of discharging gas in the first connection channel to outside of the first connection channel.

18. The maintenance method of the liquid jetting apparatus according to claim 17, further comprising comparing, with a predetermined number of times, the number of times the first liquid jetting head performs the flashing operation since the time at which the shortage of the first liquid has been detected up to the time at which the shortage of the first liquid is solved, wherein the air-discharge operation is performed based on a result of the comparison.

* * * * *